US006923259B2

(12) United States Patent
Snow

(10) Patent No.: US 6,923,259 B2
(45) Date of Patent: Aug. 2, 2005

(54) MULTI-LATERAL WELL WITH DOWNHOLE GRAVITY SEPARATION

(75) Inventor: Thomas M. Snow, Canterbury (AU)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/341,946

(22) Filed: Jan. 14, 2003

(65) Prior Publication Data

US 2004/0134654 A1 Jul. 15, 2004

(51) Int. Cl.[7] ..... E21B 43/38
(52) U.S. Cl. ..... 166/265; 166/106
(58) Field of Search ..... 166/50, 265, 105, 166/106, 313

(56) References Cited

U.S. PATENT DOCUMENTS

| | | | | | |
|---|---|---|---|---|---|
| 2,404,341 | A | * | 7/1946 | Zublin | 166/306 |
| 2,857,002 | A | * | 10/1958 | Pevere et al. | 166/303 |
| 3,064,729 | A | * | 11/1962 | Lindley | 166/297 |
| 3,159,214 | A | * | 12/1964 | Carter | 166/252.1 |
| 4,396,230 | A | * | 8/1983 | Wood et al. | 299/4 |
| 5,497,832 | A | * | 3/1996 | Stuebinger et al. | 166/369 |
| 6,068,053 | A | | 5/2000 | Shaw | 166/267 |
| 6,089,322 | A | * | 7/2000 | Kelley et al. | 166/370 |
| 6,213,208 | B1 | * | 4/2001 | Skilbeck | 166/265 |
| 2003/0066649 | A1 | * | 4/2003 | Koot et al. | 166/306 |

FOREIGN PATENT DOCUMENTS

| | | | | |
|---|---|---|---|---|
| CA | 2253685 | | 11/1998 | 43/34 |
| GB | 2326895 | A * | 1/1999 | E21B/43/38 |
| GB | 2359575 | A * | 8/2001 | E21B/43/38 |
| WO | WO 96/30625 | | 3/1996 | |
| WO | WO 9630625 | A1 * | 10/1996 | E21B/43/14 |
| WO | WO 97/41330 | | 5/1997 | |

OTHER PUBLICATIONS

Stuebinger, Lon A. and Elphingstone, Jr., Gerald M. (1998) "Multipurpose Wells: Downhole Oil Water Separation in Your Future", SPE 49050, Sep. 27–30, 1998, pp. 205–214.

Ehlig, C. A. and Economides, M. J. (2000) "Single Well Reservoir Management—the Ultimate Multibranch Well Challenge", SPE 59447, Apr. 25–26, 2000, pp. 1–4.

* cited by examiner

*Primary Examiner*—David Bagnell
*Assistant Examiner*—Daniel P Stephenson
(74) *Attorney, Agent, or Firm*—Nelson Jaramillo; Brent R. Knight

(57) ABSTRACT

The invention provides a method for recovering hydrocarbons from a subterranean production interval while reducing the percentage of water produced. A lateral well is drilled from an existing primary well. A submersible pump is deployed to a position in the primary well below the intersection with the lateral well. The pump injects the separated water into the production interval through the primary well, at a rate sufficient to allow the gravity separation of the hydrocarbons and water in the area above the submersible pump. Suitable submersible pumps include an electric submersible pump, a cavity pump and a rod pump. One or more lateral wells may be used. The lateral wells can intersect the same production interval as the primary well or can intersect an unconnected production interval.

16 Claims, 2 Drawing Sheets

MULTI-LATERAL WELL WITH DOWNHOLE GRAVITY SEPARATION

FIELD OF THE INVENTION

This invention relates to a method for extending the productive life of a hydrocarbon well by reducing the percentage of water produced to the surface through the use of downhole gravity separation in conjunction with lateral wells.

BACKGROUND OF THE INVENTION

In the process of producing hydrocarbons, most wells also produce significant amounts of water. This percentage of the produced fluids that consists of water or brine is known as the watercut. Most wells produce with an ever increasing watercut throughout their productive life. In fact, the end of a well's productive life is often determined by the watercut; a well is typically shut in when the value of the hydrocarbons produced is no longer sufficient to economically cover the operating costs of the well and the cost of disposing of the water.

Not only does the watercut affect the profitability of most wells, since the higher the watercut the lower the percentage of the production that consists of hydrocarbons, but the watercut also directly affects the operation costs. This is because in most wells, the disposal cost of handling the watercut includes the operating costs of bringing the water to the surface, separating the water from the hydrocarbons, and disposing of the separated water, often by re-injecting the water back into the subsurface. Therefore, decreasing the watercut of a well directly increases the value of the produced fluids and directly decreases the disposal costs.

One method of reducing the watercut of a well is to separate the water from the hydrocarbons downhole, rather than at the surface. Downhole separation increases the value of the fluids produced to the surface. Downhole separation also facilitates downhole disposal of the separated water. The separated water can be reinjected into the same production interval or into a different production interval. Separation can be achieved naturally, through gravity, or mechanically, for example through the use of a centrifuge. However, a mechanical separator greatly complicates well maintenance. Injection zones are prone to plugging and where mechanical separation is employed, correction of the plugging first requires removal of the separator.

Another way to improve the productivity of a well is to increase the length of the intersection of the productive interval by the well completion. One way of increasing this intersection length is through the use of multi-lateral wells. A multi-lateral well is a conventional well that has an additional "leg" or lateral well that is drilled from a point in the original well. The lateral well increases productivity by allowing additional intersection length along the productive interval without the cost and delay involved in re-drilling the upper part of the well. While multi-laterals enable multiple intersections within the same productive interval, multi-laterals also enable the intersection of different productive intervals within a reservoir. The use of multi-laterals increases the potential production of a well and can enable alternate water disposal locations, in the event that reinjection to the same productive interval is undesired.

Methods employing mechanical downhole separation have been taught for use in both conventional and multi-lateral wells. However, application of mechanical downhole separation has been limited, perhaps because of the difficulties and costs involved in repairing plugged injection zones. As discussed above with reference to conventional wells, these teachings that combine the use of mechanical downhole separation of the produced water and hydrocarbons with multi-laterals typically involve the use of a centrifuge to separate the production fluids. Just as in conventional wells, there are several drawbacks to these methods: they are mechanically complex; expensive to install; difficult to repair; and if access to the injection zone is required, then the separator must first be removed.

Accordingly, there remains a need for a method of production which extends the economic and productive life of a well by reducing the watercut, and thereby, reducing the operating and water disposal costs while avoiding the added expense, complexities and repair limitations inherent in the currently known methods.

SUMMARY OF THE INVENTION

One embodiment of the present invention provides a method for recovering hydrocarbons from a subterranean production interval while reducing the percentage of water produced, comprising: (a) drilling a lateral well from a primary well, (b) deploying a submersible pump to a position in the primary well below the intersection with the lateral well, (c) allowing hydrocarbons and water to separate by gravity, and (d) pumping water into the production interval, at a rate sufficient to allow gravity separation of the water and hydrocarbons in the area above the submersible pump, while producing the hydrocarbons to the surface.

Another embodiment of the present invention provides a method for recovering hydrocarbons from a subterranean production interval while reducing the percentage of water produced, comprising: (a) drilling a lateral well from an existing primary well, wherein the lateral well terminates in the same production interval as the primary well; (b) installing tubing in the primary well, wherein the tubing includes means to allow an inflow of fluid into the tubing from the well; (c) deploying a variable speed submersible pump to a position in the tubing below the intersection with the lateral well; and (d) pumping water into the production interval, through the primary well, at a rate sufficient to allow the gravity separation of the water and hydrocarbons in the area above the variable speed submersible pump.

In another embodiment, the present invention provides a well completion system comprising: (a) a primary well extending from the surface to a subterranean production interval; (b) a lateral well extending from the primary well to the subterranean production interval; (c) a tubing string extending from the surface to a location within the lateral well below the intersection with the primary well, wherein the tubing includes means to allow inflow of fluid; and (d) a submersible pump located within the tubing, below the intersection of the lateral well with the primary well, wherein the pump operates at a rate sufficient to allow the gravity separation of the water and hydrocarbons in the area above the pump.

BRIEF DESCRIPTION OF THE DRAWINGS

The present invention and its advantages will be better understood by referring to the following detailed description and the attached drawings in which.

Figure 1:
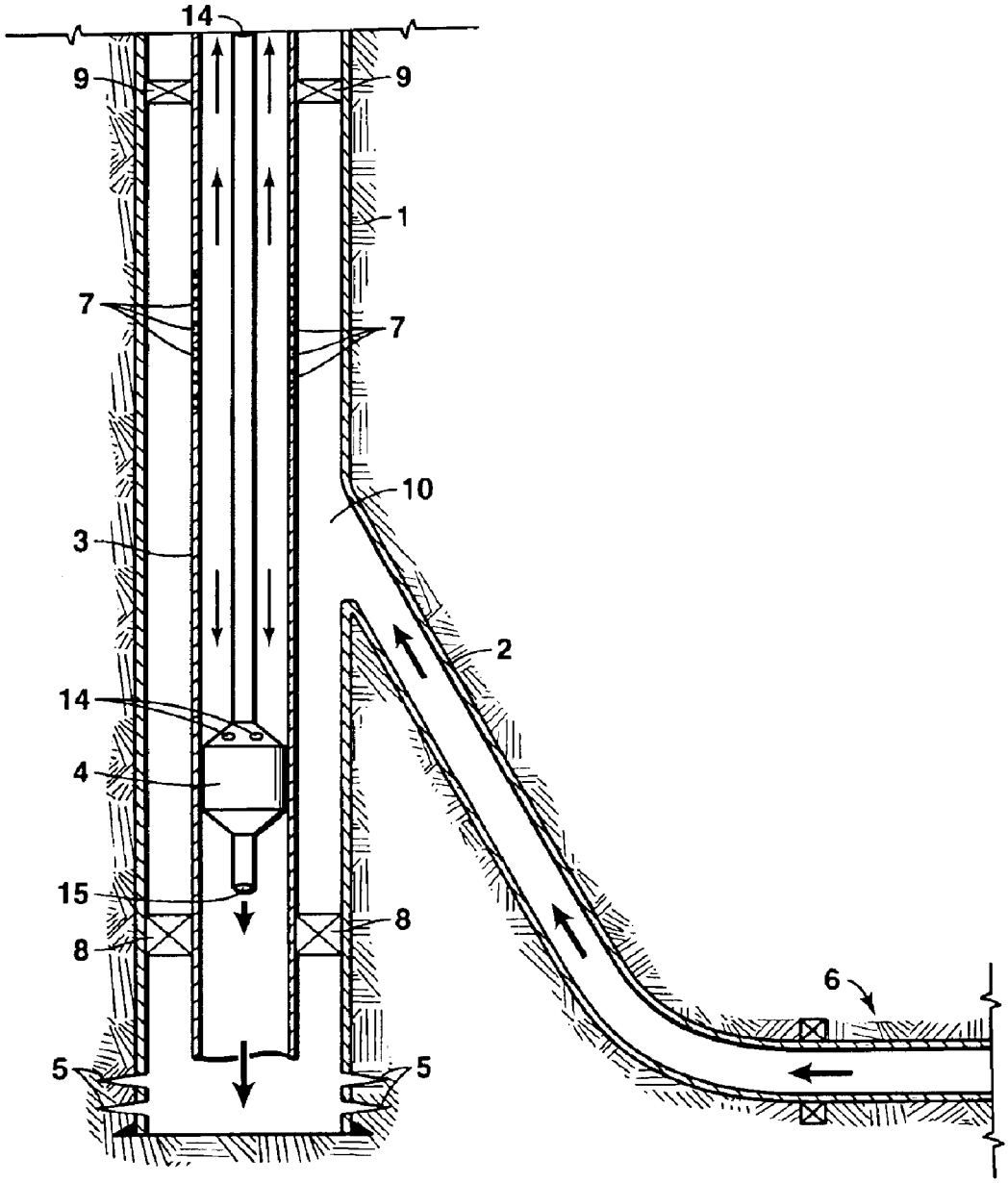
FIG. 1 is an elevation view of an embodiment of the invention where a single lateral well intersects the primary well.

The drawings are not intended to exclude from the scope of the invention other embodiments that are the result of normal and expected modifications of these specific embodiments. Various items, such as wellhead equipment, treatment stages, alternate perforation types, and repetitive features, have been omitted from the drawings for the purposes of simplicity and clarity of presentation. Items having like numerals are similar or have similar functions.

DETAILED DESCRIPTION OF THE INVENTION

In the following detailed description, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the invention, as defined by the appended claims.

This invention requires that a lateral well be drilled from an existing primary well. A submersible pump is positioned in the primary well, below its intersection with the lateral well. The fluids above the submersible pump are allowed to separate through gravity into water and hydrocarbons. The submersible pump is able to be run at various speeds and the speed at which the submersible pump injects the separated water into the production interval intersected by the primary well is controlled so as to continue to allow the gravity separation of the produced fluids. The submersible pump is preferably electric, however, suitable pumps also include cavity pumps, rod pumps, or any other pumping device suited to the present invention. This invention can be used to enable downhole separation and injection of water into the production interval of the original primary well or into another production interval which may be connected or unconnected to the production interval being produced.

An improved method and system for downhole water separation and disposal is disclosed. One or more lateral wells can be utilized. The pump can also be located in a lateral well instead of in the primary well. In addition, a tubing string can be run from the surface to a location in the primary well below the intersection with the lateral well. The tubing would transport the hydrocarbons to the surface and the water to the submersible pump. Therefore, the tubing in the area where the fluids are separating through gravity would have to allow the influx of fluids from the well. The invention may utilize tubing perforated in the area above the submersible pump, however methods of allowing the necessary inflow of fluids into the tubing are not limited to perforations.

The present invention may be particularly useful in moderate flow rate wells, for example 500–5000 barrels of fluid per day. Most multi-laterals are planned for very high rate wells—up to 50,000 barrels of fluid per day. These high rate wells will have substantially less time for the fluids to separate naturally, so adequate gravity separation is much less likely. In addition, the large revenue associated with these high rate wells has led to focusing on more expensive solutions. These low rate wells (in the 200 barrel per day range or less) tend to be shallow, and relatively inexpensive to drill, so there is little incentive to apply multi-lateral technology to save drilling costs.

FIG. 1 illustrates a primary well 1 with one lateral well 2 drilled from a point within the primary well 1 to a production interval 6. In this example, the primary well 1 intersects an original production interval 5. In an embodiment of this invention, tubing 3 is inserted into the primary well 1 extending to a point below its intersection 10 with the lateral well 2. A lower annular plug 8 prevents fluid communication between the intersection 10 and the original production interval 5 except through the tubing 3. A upper annular plug 9 prevents fluid communication between the intersection 10 and the surface production facilities (not shown) except through the tubing 3. In this example, perforations 7 in the tubing 3 allow the influx of production fluids from the area above the intersection 10 of the primary well 1 and the lateral well 2. Any alternative mechanism to allow fluid flow from the primary well 1, between upper annular plug 9 and lower annular plug 8, into the tubing 3, at a rate sufficient to allow gravity separation, is acceptable. An electric submersible pump 4 has been deployed within the tubing 3 to a position below the perforations 7. The electric submersible pump 4 is operated at a speed that enables the injection of water from inlet or inlets 14 into the original production interval 5 through outlet 15, by allowing the gravity separation of the produced fluids in the area above the electric submersible pump 4.

Figure 2:
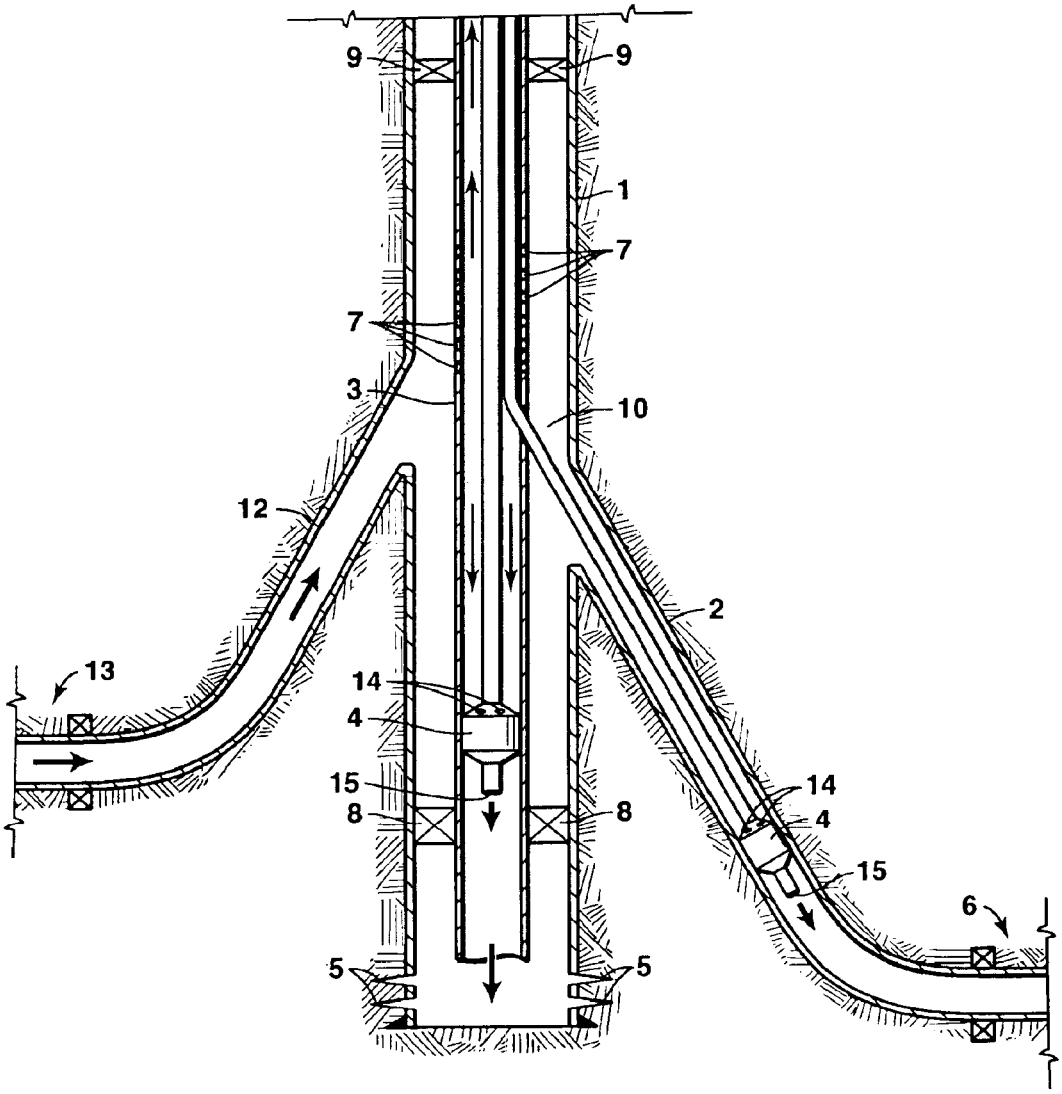
FIG. 2 is an elevation view of an embodiment of the invention where two lateral wells intersect the primary well.

FIG. 2 illustrates another possible embodiment of the invention that includes the addition of a second lateral well 12. In this embodiment, the second lateral well 12 intersects the primary well 1 between upper annular plug 9 and lower annular plug 8. The second lateral well 12 can intersect the same production interval as the primary well 1, or the same production interval intersected by the lateral well 2, or as in this example, it may intersect with an unconnected production interval 13. In alternate embodiments, additional lateral wells may be drilled from the primary well 1 in such a way as to allow water injection into the original production interval 5 and may have a plurality of submersible pumps 4.

This invention will allow the disposal of produced water downhole, minimizing operating expense and allowing more oil to be economically produced. It represents an improvement over gravity separation in a conventional well because the water can be injected at a location some distance away from the producing well.

The well completion system will be constructed with the following steps: 1. drill and complete a primary well, producing from it until it reaches an uneconomic watercut; 2. create a lateral well by adding a second "leg" to the original hole; 3. complete the lateral well; 4. remove the sidetracking equipment and "recover" the original completion; 5. run tubing from surface to the original completion with packers; 6. place a plug in the original well, and begin producing from the lateral well; 7. after the well is producing a significant amount of water, pull the plug on the original completion, and deploy an electric submersible pump on coiled tubing; and 8. use the variable speed on the pump to control the rate of water injection into the original primary well. This design allows water to separate by gravity from the oil while flowing up the lateral, and in the area of the junction. The quality of separation will be dependent on flow rates, oil and water density, and emulsion characteristics of the fluids. It is anticipated that some water will be produced to the surface with the oil, and that a trace amount of oil will be injected with the water. The preferred operating conditions will be different for each application. This method is preferable to other downhole separation methods because it is mechanically simple (minimal moving parts), and it provides easy access to the main wellbore for re-entry if the injection completion plugs.

The invention will initially be deployed as described above. An existing primary well that will no longer produce at economic rates will be used to create the multi-lateral well. The primary well is a conventional well that makes a high watercut. It will be sidetracked and a horizontal lateral will be drilled and completed. Then the original completion will be recovered using standard multi-lateral techniques, and a plug will be installed in this completion. Oil and water will be produced from the lateral until such time as the well is making a significant and stable watercut. Then the plug in the lower zone will be pulled, and the pump will be deployed on coiled tubing. Using a variable speed controller on the pump will allow injection of water, with a minimal loss of oil.

In this method, the oil reservoir, which is produced by the horizontal lateral, has weak water support, and requires injection to maintain pressure. By utilizing the old completion in addition to drilling the sidetrack, an injection well and a production well are obtained. Additionally, the surface handling of the fluids is substantially reduced. Since the water is returning to the same reservoir where the production is coming from, a small amount of oil carried down with the water will not be of concern. Also, since the water production and injection are in the same reservoir, the waters will be compatible and scale precipitation should not occur.

This invention could be applied with multiple types of hardware schemes, and with many different pump designs. A cement junction at the multi-lateral point (known in the industry as a level 4 multi-lateral) is typical, but any type of junction that is appropriate for the area could be applied. Similarly, cavity pumps or rod pumps could be used to pump the water or produce the oil, rather than an electric submersible pump and gas lift.

The degree of separation is dependent on flow rate, tubing/casing size, and fluid properties. Current technology makes the quality of the separation difficult to predict, however, data collected from horizontal wells suggest that the oil and water are already reasonably well separated in the horizontal section.

Although preferred embodiments of the invention have been shown and described (each embodiment is preferred for different well conditions and applications), changes and modifications may be made thereto without departing from the invention. Accordingly, the foregoing description has been directed to particular embodiments of the invention for the purpose of illustrating the invention, and is not to be construed as limiting the scope of the invention. It will be apparent to persons skilled in the art that many modifications and variations not specifically mentioned in the foregoing description will be equivalent in function for the purposes of this invention. All such modifications, variations, alternatives, and equivalents are intended to be within the spirit and scope of the present invention, as defined by the appended claims.

What is claimed is:

1. A method for recovering hydrocarbons from a subterranean production interval penetrated by a well, while reducing the percentage of water produced, comprising:

drilling a lateral well from an existing primary well;

deploying a submersible pump to a position in the primary well below the intersection with the lateral well;

injecting water into an oil reservoir to maintain pressure;

allowing hydrocarbons and water to separate by gravity; and pumping water into the production interval through the primary well, at a rate sufficient to allow gravity separation of the water and hydrocarbons in an area above the submersible pump, while producing the hydrocarbons to the surface.

2. The method of claim 1, wherein the lateral well is drilled after the percentage of water produced by the primary well increases to the point that the primary well no longer produces hydrocarbons economically.

3. The method of claim 1, wherein both the primary well and the lateral well intersect the same production interval.

4. The method of claim 1, wherein the primary well and the lateral well intersect different production intervals.

5. The method of claim 1, wherein the primary well and the lateral well intersect unconnected production intervals.

6. The method of claim 1, further comprising drilling at least one additional lateral well.

7. The method of claim 6, wherein a plurality of submersible pumps are employed.

8. The method of claim 6, wherein the primary well and at least one of the lateral wells intersect the same production interval.

9. The method of claim 6, wherein the primary well and the lateral wells intersect different production intervals.

10. The method of claim 6, wherein the primary well and the lateral wells intersect unconnected production intervals.

11. The method of claim 1, further comprising installing tubing from the surface to below the intersection of the primary and lateral wells, said tubing including means to allow an inflow of fluid.

12. The method of claim 1, wherein the submersible pump is selected from the group consisting of an electric submersible pump, a cavity pump, or a rod pump.

13. The method of claim 1, wherein the submersible pump's rate of operation is adjusted in response to variations in the percentage of water being produced so as to allow gravity separation of the water and hydrocarbons in an area above the submersible pump.

14. A method for recovering hydrocarbons from a subterranean production interval while reducing the percentage of water produced, comprising:

drilling a lateral well from an existing primary well, wherein said lateral well terminates in the same production interval as said primary well;

installing tubing in said primary well, wherein said tubing includes means to allow an inflow of fluid into the tubing from the well;

deploying a variable speed submersible pump to a position in said tubing below the intersection with the lateral well;

injecting water into the subterranean production interval to maintain pressure; and pumping water into said production interval, through said primary well, at a rate sufficient to allow the gravity separation of the water and hydrocarbons in the area above the variable speed submersible pump.

15. A well completion system comprising:

a primary well extending from the surface to a subterranean production interval;

a lateral well extending from the primary well to said subterranean production interval;

a tubing string extending from the surface to a location within said primary well below the intersection with said lateral well, wherein said tubing includes means to allow inflow of fluid; and a submersible pump located within the tubing, beyond the intersection of the lateral well with the primary well, wherein said pump injects water from the surface and the area above the pump into said production interval at a rate sufficient to allow the gravity separation of the water and hydrocarbons in the area above the pump and to maintain pressure.

16. The system of claim 15 comprising a second submersible pump located within said lateral well.

* * * * *